US007507931B2

(12) United States Patent
Saxl et al.

(10) Patent No.: US 7,507,931 B2
(45) Date of Patent: Mar. 24, 2009

(54) SWITCHING CHAMBER FOR A GAS-INSULATED HIGH-VOLTAGE CIRCUIT BREAKER

(75) Inventors: David Saxl, Zurich (CH); Markus Vestner, Buesingen (CH)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 11/833,373

(22) Filed: Aug. 3, 2007

(65) Prior Publication Data

US 2007/0272659 A1 Nov. 29, 2007

Related U.S. Application Data

(63) Continuation of application No. PCT/CH2006/000035, filed on Jan. 16, 2006.

(30) Foreign Application Priority Data

Feb. 10, 2005 (EP) ..... 05405061

(51) Int. Cl.
*H01H 33/74* (2006.01)

(52) U.S. Cl. ..... 218/46; 218/53; 218/68; 218/81

(58) Field of Classification Search ..... 218/43–46, 218/51–57, 59, 61–64, 72, 73, 76–81, 84, 218/85

See application file for complete search history.

(56) References Cited

U.S. PATENT DOCUMENTS 3,670,287 A * 6/1972 Keto ..... 439/39

(Continued)

FOREIGN PATENT DOCUMENTS

DE 42 17 697 A1 9/1993

(Continued)

OTHER PUBLICATIONS

English language version of Form PCT/IB/409 (International Preliminary Report on Patentability).

(Continued)

*Primary Examiner*—Elvin G Enad
*Assistant Examiner*—Marina Fishman
(74) *Attorney, Agent, or Firm*—Buchanan Ingersoll & Rooney PC

(57) ABSTRACT

The switching chamber is intended for a gas-insulated high-voltage circuit breaker. It contains an axially symmetrical housing and a contact arrangement held in the housing with two switching pieces, of which at least one is arranged such that it can move along the housing axis. The switching chamber housing has two hollow bodies consisting of electrically conductive material which can be connected to a high voltage and an insulating tube holding the hollow bodies axially at a distance. A separation zone, which is electrically shielded during operation of the circuit breaker, is formed in the surface of at least one of the two hollow bodies and separates two surface zones having different degrees of roughness from one another in the hollow body. In homogeneities in the surface of the switching chamber housing which may reduce the dielectric strength of the circuit breaker equipped with the switching chamber therefore do not have any effect. For this reason, the switching chamber and the circuit breaker are characterized by a high degree of operational reliability and safety with a simple design.

13 Claims, 1 Drawing Sheet

U.S. PATENT DOCUMENTS

| | | | | |
|---|---|---|---|---|
| 3,911,239 | A * | 10/1975 | Lafferty | 218/121 |
| 4,527,862 | A * | 7/1985 | Arakawa | 349/12 |
| 6,495,785 | B1 | 12/2002 | Meyer | |

FOREIGN PATENT DOCUMENTS

| | | |
|---|---|---|
| FR | 1.081.107 | 12/1954 |

OTHER PUBLICATIONS

Form PCT/ISA/210 (International Search Report) dated Mar. 20, 2006.
Form PCT/ISA/237 (Written Opinion of the International Searching Authority).
Form PCT/IPEA/409 (International Preliminary Report on Patentability) Jan. 24, 2007.
European Search Report (with English translation of category of cited documents) dated Jul. 15, 2005.

* cited by examiner

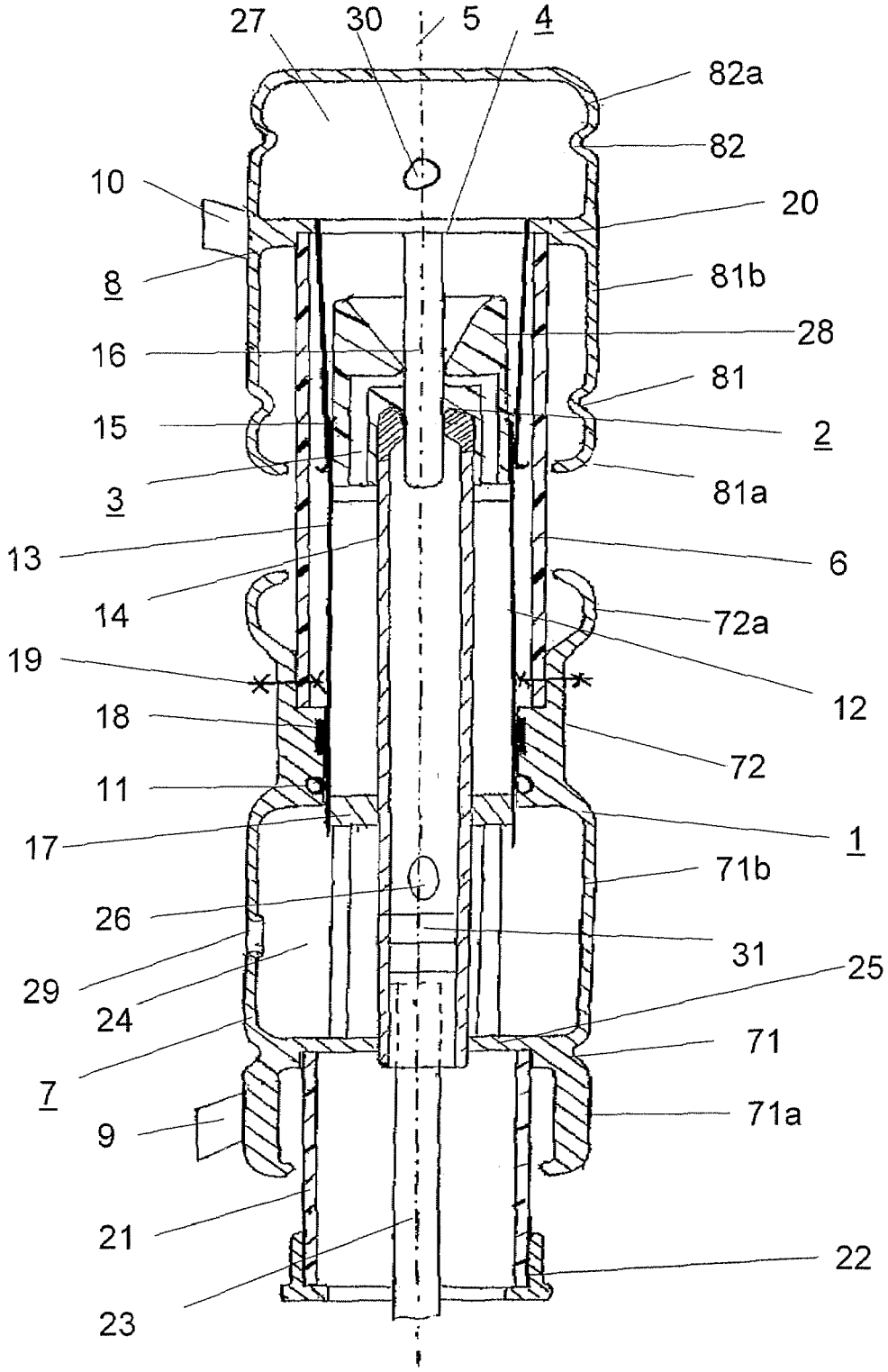
27
30
5
4
82a
82
10
20
8
81b
28
16
81
15
2
3
81a
13
6
14
72a
19
12
18
72
11
1
17
71b
26
31
29
25
24
71
7
71a
9
21
22
23

SWITCHING CHAMBER FOR A GAS-INSULATED HIGH-VOLTAGE CIRCUIT BREAKER

RELATED APPLICATIONS

This application claims priority under 35 U.S.C. §119 to EP Application 05405061.2 filed in Europe on Feb. 10, 2005, and as a continuation application under 35 U.S.C. §120 to PCT/CH2006/000035 filed as an International Application on Jan. 16, 2006, designating the U.S., the entire contents of which are hereby incorporated by reference in their entireties.

TECHNICAL FIELD

The present disclosure relates to a switching chamber for a gas-insulated high-voltage circuit breaker.

BACKGROUND INFORMATION

A switching chamber of the type mentioned at the outset is described in U.S. Pat. No. 6,495,785 B1. This switching chamber is arranged in a metal container filled with insulating gas and has an axially symmetrical housing borne by a post insulator 50, in which housing a contact arrangement with a stationary and an axially movable switching piece is arranged. The switching chamber housing is formed by two electrically conductive hollow bodies 43, 44, by mounting tubes and flanges 51, which are fixed to the hollow bodies, and by an insulating tube 50, which is fixed to the mounting parts 51 and holds the hollow bodies at a distance in the direction of the housing axis. The hollow body 43 is connected to a movable switching piece and the hollow body 44 is connected to a stationary switching piece of the contact arrangement. Current conductors 45, 47, which are connected to a high voltage, are guided from the outside through the wall of the container 40 via two outdoor bushings 41, 42. Those ends of the current conductors 45, 47 which are located in the interior of the container are guided into drilled holes which are formed in the hollow bodies 43, 44, which apparently are each in the form of a cast metal part, so as to form two electrical plug-in connections. The two hollow bodies shield regions on the insulating tube 50 and on the post insulator 50 which are subjected to severe dielectric loads and they contain exhaust volumes for accommodating hot arcing gases.

DE 42 17 697 A1 describes an electrical high-voltage circuit breaker having two contact pieces, which are coaxially opposite one another. One of the two contact pieces is fixed on a tubular contact-piece mount. The contact-piece mount and the contact piece borne by it are surrounded by a hollow-cylindrical shielding body, which is detachably connected to the contact-piece mount by a latching connection arranged on the inner side of the shielding body. The outer side of the shielding body can therefore be designed to be entirely smooth and without any protruding parts, which could bring about a distortion of the electrical field at the circuit breaker.

SUMMARY

A switching chamber and a gas-insulated high-voltage circuit breaker containing this switching chamber are disclosed which can be characterized by a high degree of operational reliability and safety with a simple design.

In the switching chamber according to the invention, a separation zone, which is electrically shielded during operation of the circuit breaker, is formed in the surface of at least one of the two hollow bodies and separates two surface zones having different degrees of roughness from one another in the hollow body. A switching chamber having such a design and a high-voltage circuit breaker equipped with said switching chamber are characterized by a high dielectric strength and correspondingly also by a high degree of operational reliability and safety. A high dielectric strength presupposes hollow bodies having a low degree of surface roughness. Since the hollow bodies are manufactured as a cast metal part and therefore may have peak-to-valley heights in the region of 100 μm or more, the outer surface of the cast part needs to be considerably reduced in the dielectrically critical regions by metal-removing machining, in particular lathe work, milling and/or grinding, and/or by one or more machining steps which do not involve metal removal, in particular polishing, shot-peening, sandblasting and/or hammering. In these regions, the surface is partially smoothed until peak-to-valley heights of a few μm are achieved. Inhomogeneities arising in the process at the common interface between the surface zone having a high degree of roughness and the surface zone having a low degree of roughness are now located in the electrically shielded separation zone and can now no longer reduce the dielectric strength of the switching chamber and of the circuit breaker equipped with said switching chamber.

Particularly effective shielding of the dielectrically critical transition region is achieved if the separation zone is in the form of a depression which extends annularly around the housing axis. If the hollow bodies are in the form of a cast metal part, such a depression can be manufactured directly during casting by selecting a suitable casting mold.

A simplification of the design of the switching chamber whilst maintaining a high degree of operational reliability and safety is achieved by virtue of the fact that one end of the insulating tube is mounted with its lateral face on a section, which is guided around the housing axis, of the inner face of one of the two hollow bodies and is connected to the hollow body at the bearing point. In this case, the connection means are advantageously arranged in the separation zone.

A further simplification of the switching chamber whilst at the same time increasing its operational reliability and safety is achieved with a hollow body in whose inner face a guide ring and/or a contact ring are mounted, which rest on a part of the movable switching piece which is used to guide the circuit breaker current and is in the form of a puffer cylinder of a compression device.

By forming at least one passage opening in the hollow body which is guided from the surface zone having a greater degree of roughness into the interior of the hollow body provided for accommodating exhaust gases and has a securing edge pointing into the interior, a further function is integrated in the hollow body and, as a result, the design of the switching chamber is simplified and its operation made safer and more reliable.

The switching chamber can be connected in a simple and safe manner to a high-voltage-carrying current source if a contact face is formed in the lateral face of the at least one hollow body for the purpose of bearing an electrical connection which can be fixed to the hollow body. In a manner which is advantageous in terms of manufacturing, the contact face of the hollow body is integrated in the surface zone having a lower degree of roughness.

BRIEF DESCRIPTION OF THE DRAWING

An exemplary embodiment of the invention will be explained in more detail below with reference to the drawing. Here, the single FIGURE shows a plan view of a section passed axially through an embodiment of a switching chamber according to the invention with an axially symmetrical housing accommodating a contact arrangement.

DETAILED DESCRIPTION

The present disclosure relates to a switching chamber for a gas-insulated high-voltage circuit breaker. Such a switching chamber contains an axially symmetrical housing and a contact arrangement held in the housing with two switching pieces, of which one is arranged such that it can move along the housing axis. The switching chamber housing has two hollow bodies consisting of an electrically conductive material and an insulating tube, which holds the two hollow bodies at a distance in the direction of the housing axis. During operation of the high-voltage circuit breaker, the switching chamber is at a high-voltage potential and, in particular during tripping, is subjected to strong electrical fields. Since the switching chamber also accommodates the hot arcing gases formed during a switching operation, it is at the same time also subjected to severe mechanical and thermal loads. The switching chamber is preferably used in gas-insulated high-voltage circuit breakers with a container which is filled with insulating gas and is provided with protection against electric shock.

The single FIGURE shows a switching chamber for a gas-insulated high-voltage circuit breaker. This switching chamber contains a largely axially symmetrical housing 1, which is filled with an insulating gas, for example based on nitrogen and/or sulfur hexafluoride, and a contact arrangement 2, which is accommodated by the switching chamber housing 1 and is likewise largely axially symmetrical. The contact arrangement 2, which is illustrated closed, has two switching pieces 3, 4, of which the switching piece 3 is arranged such that it can move along the housing axis 5, and the switching piece 4 is held fixed in position in the housing 1. The switching piece 4 does not necessarily need to be fixed; it may also be movable.

The housing 1 is formed by two hollow bodies 7, 8 consisting of an electrically conductive material which are rigidly connected to one another via an insulating tube 6. These hollow bodies are generally manufactured from a cast metal, for example based on steel or aluminum, and accommodate the exhaust gases formed in the event of a switching operation in the contact arrangement 2. The hollow body 7 can be connected to a high voltage via an electrical connection 9, and the hollow body 8 can be connected to a high voltage via an electrical connection 10. When the contact arrangement 2 is closed, the hollow bodies 7, 8 conduct current fed in at the electrical connections 9, 10 to the contact arrangement 2. The hollow body 7 passes this current, via a contact ring 11 mounted in a section of the inner face of the hollow body 7, to a metallic puffer cylinder 12 and therefore to a rated current contact 13 in the form of a hollow cylinder and to a tubular arcing contact 14, which passes coaxially through the rated current contact 13, of the switching piece 3. The hollow body 8 passes the current directly to a rated current contact 15, which is likewise in the form of a hollow cylinder, and to an arcing contact 16, which is in the form of a pin, of the switching piece 4.

The puffer cylinder 12 is part of a compression device, which also comprises a puffer piston 17, which is in the form of a ring and is mounted fixedly on the switching chamber housing 1, and which compression device, when the contact arrangement 2 opens, blows fresh quenching gas into an arcing zone formed between the two arcing contacts 14, 16 during the opening. Safe displacement of the puffer cylinder 12 and at the same time protection of the contact ring 11 is ensured by a guide ring 18 mounted in an adjoining section of the inner face of the hollow body 7. The lower end of the insulating tube 6 with an end section of its lateral face is mounted in a further section of the inner face of the hollow body 7 and is rigidly connected to the hollow body 7 via connection means 19, such as screws, rivets or bonding points. The upper end of the insulating tube 6 is connected to a bearing ring 20 formed in the insulating tube, to which bearing ring the switching piece 4 is also fitted in an electrically conductive manner.

The switching chamber housing 1 is mounted on a hollow post insulator 21, which for its part is held on a flange 22 of a metal container which is filled with insulating gas and accommodates the switching chamber. An insulating rod 23 is fixed with its upper end to the lower end of the hollow arcing contact 14. At its lower end which can no longer be seen, the insulating rod 23 is connected to a drive (which is likewise not shown in FIG. 1).

An exhaust volume 24 surrounded by the hollow body 7 is axially delimited by the puffer cylinder 12 and the puffer piston 17 or a transverse wall 25 and towards the inside by the arcing contact 14, which is passed in a gas-tight manner through the puffer piston 17 and the transverse wall 25. A passage opening 26 is formed in a tube section of the arcing contact 14, is located beneath the puffer piston 17 and connects the interior of the arcing contact 14, which has been sealed off at the bottom in a gas-tight manner by a metal insert 31, to the exhaust volume 24. An exhaust volume 27 surrounded by the hollow body 8 is axially delimited by a radially guided wall of the hollow body 7 or an insulating nozzle 28 fitted to the movable switching piece 3. Passage openings 29, 30 provided in the walls of the hollow bodies 7 and 8, respectively, connect the exhaust volumes 24 and 27, respectively, to an insulating gas volume surrounded by the container (not illustrated).

In addition to the above-described functions involving mechanical bearing, conducting electrical current and accommodating hot gases, however, the hollow bodies 7 and 8 also fulfill the function of controlling an electrical field which acts, when the contact arrangement 2 is closed, between the switching chamber housing 1 and the surrounding environment, for example the container accommodating the switching chamber housing and having the flange 22. During tripping, this electrical field additionally also acts between the two separate switching pieces 3 and 4.

In order to safely fulfill the abovementioned field-control function, separation zones 71 or 72 or 81 or 82 are formed in the surfaces of the two hollow bodies 7, 8, which separation zones each separate two surface zones 71*a* and 71*b* or 72*a* and 71*b* or 81*a* and 81*b* or 82*a* and 81*b* of the hollow bodies 7, 8 having different degrees of roughness from one another. The separation zones are designed such that, during operation of the switching chamber in a circuit breaker connected to a high voltage, they are shielded from the electrical field. This ensures that the surface zones 71*a*, 72*a*, 81*a*, 82*a* of the switching chamber which have a lower degree of roughness can be subjected to higher electrical field strengths than the surface zones 71*b*, 81*b* having a higher degree of roughness. In the electrically shielded separation zones 71, 72, 81, 82 provided between the surface zones having different degrees of roughness, dielectrically critical transition regions are effectively shielded. Such dielectrically critical transition regions are assisted by the smoothing of the surface zones 71*a*, 72*a*, 81*a*, 82*a* of a hollow body 7, 8 removed from a casting mold, to be precise at the interface between the unsmoothed and the smoothed (cast) surface. The surface zones having a low degree of roughness are primarily the mutually facing end sides of the hollow bodies 7, 8, which are connected to one another via the insulating tube 6, but also the ends of the switching chamber housing 1, in particular the end side of the hollow body 7 which faces the post insulator 21 and the insulating rod 23.

The separation zones, for example 72 or 81, are generally in each case in the form of a depression which extends annularly around the housing axis 5. The unsmoothed surface zone 71*b* or 81*b* produced directly during casting of the hollow bodies 7, 8 merges with the smoothed surface zone, for example 72*a* and 81*a*, in this depression, which is largely shielded from the effect of the electrical field, without it being possible for the dielectrically critical transition to be effective at the interface between the smoothed and the unsmoothed surface zone. In addition to the separation zone, parts, such as the connection means 19, can also be arranged in the electrically shielded depression, which parts may otherwise reduce the dielectric strength at this point.

The passage openings 29 and 30 are formed in the hollow bodies 7 and 8 at the surface zones 71*b* and 81*b* which can be subjected to lower electrical field strengths. In order to avoid undesirable field increases, these passage openings each have a securing edge pointing into the exhaust volume 24 or 27, which securing edge is only visible in the opening 29, however.

In addition, two contact faces, which have not been provided with a designation, are designed to be flat or curved and are used for bearing the electrical connection 9 or 10, which can be fixed to the hollow body 7 or 8, are located in the lateral faces of the hollow bodies 7 and 8. Mating contact faces, which rest on the two contact faces, are formed in the two electrical connections. Owing to these measures, effective current transfer from the electrical connection 9 or 10 to the switching chamber is ensured. Since the smoothed contact face of the hollow body 7 is integrated in the surface zone 71*a*, the production of this contact face in a manner which is advantageous in terms of manufacturing is superfluous. As shown with the electrical connection 10, a current transfer can in principle also be fixed in an unsmoothed surface zone, in this case 81*b*, on the hollow body, in this case 8, but the contact face then needs to be manufactured by smoothing a section of this surface zone.

LIST OF REFERENCE SYMBOLS

1 Switching chamber housing
2 Contact arrangement
3, 4 Switching pieces
5 Housing axis
6 Insulating tube
7, 8 Hollow body
9, 10 Electrical connection
11 Contact ring
12 Puffer cylinder
13, 15 Rated current contacts
14, 16 Arcing contacts
17 Puffer piston
18 Guide ring
19 Connection means
20 Bearing ring
21 Post insulator
22 Flange
23 Insulating rod
24 Exhaust volume
25 Bearing ring
27 Exhaust volume
26, 29, 30 Passage openings
28 Insulating nozzle
31 Metal insert
71, 72, 81, 82 Separation zones
71*a*, 72*a*, 81*a*, 82*a* Surface zones
71*b*, 81*b*

What is claimed is:

1. A switching chamber for a gas-insulated high voltage circuit breaker, containing an axially symmetrical housing and a contact arrangement held in the housing with two switching pieces, of which at least one is arranged such that it can move along the housing axis, in which the switching chamber housing has two hollow bodies which are each in the form of a cast metal part, which can be connected to a high voltage and an insulating tube holding the hollow bodies axially at a distance, wherein a first separation zone is formed in the surface of at least one of the two hollow bodies and separates two surface zones having different degrees of roughness from one another in the hollow body, of which the first surface zone is an unsmoothed surface of the hollow body and the second surface zone having a lower degree of roughness is a smoothed end side of the at least one hollow body, and wherein the first separation zone is in the form of a depression which extends annularly around the housing axis.

2. The switching chamber as claimed in claim 1, wherein one end of the insulating tube is mounted with a lateral face on a first section, which is guided around the housing axis, of the inner face of a first of the two hollow bodies and is connected to the first hollow body at the first section.

3. The switching chamber as claimed in claim 2, wherein connection means are arranged in the first separation zone.

4. The switching chamber as claimed in claim 2, wherein a guide ring and/or a contact ring are mounted in a second section of the inner face of the first hollow body, which guide ring and/or contact ring rest on a part of the movable switching piece which is used to guide the circuit breaker current and is in the form of a puffer cylinder of a compression device.

5. The switching chamber as claimed in claim 1, wherein a passage opening is formed in the at least one hollow body, is guided from the surface zone into the interior of the hollow body provided for accommodating the exhaust gases and has a securing edge pointing into the interior.

6. The switching chamber as claimed in claim 1, wherein a second separation zone is formed in the at least one hollow body and separates a third surface zone having a higher degree of roughness from a fourth surface zone having a lower degree of roughness.

7. The switching chamber as claimed in claim 1, wherein a contact face is formed in a lateral face of the at least one hollow body for the purpose of bearing an electrical connection which can be fixed to the hollow body.

8. The switching chamber as claimed in claim 7, wherein the contact face is integrated in the second surface zone having a lower degree of roughness.

9. A high-voltage circuit breaker having a switching chamber as claimed in claim 1.

10. The switching chamber as claimed in claim 4, wherein a passage opening is formed in the at least one hollow body, is guided from the first surface zone into the interior of the hollow body provided for accommodating the exhaust gases and has a securing edge pointing into the interior.

11. The switching chamber as claimed in claim 5, wherein a second separation zone is formed in the at least one hollow body and separates a third surface zone having a higher degree of roughness from a fourth surface zone having a lower degree of roughness.

12. The switching chamber as claimed in claim 6, wherein a contact face is formed in a lateral face of the at least one hollow body for the purpose of bearing an electrical connection which can be fixed to the hollow body.

13. A high-voltage circuit breaker having a switching chamber as claimed in claim 8.

* * * * *